United States Patent [19]

Stift et al.

[11] 4,032,121

[45] June 28, 1977

[54] PROCESS FOR THE PRODUCTION OF IRON FROM IRON ORES AND APPARATUS FOR CARRYING OUT SAID PROCESS

[75] Inventors: Kurt Stift; Helwig Vacek, both of Leoben, Austria

[73] Assignee: Vereinigte Osterreichische Eisen- und Stahlwerek-Alpine Montan Aktiengesellschaft, Vienna, Austria

[22] Filed: Dec. 15, 1975

[21] Appl. No.: 640,567

Related U.S. Application Data

[62] Division of Ser. No. 551,012, Feb. 19, 1975.

[30] Foreign Application Priority Data

Feb. 22, 1974 Austria ..... 1473/74

[52] U.S. Cl. ..... 266/163; 432/106; 266/214; 266/240

[51] Int. Cl.[2] ..... C21B 13/08

[58] Field of Search ..... 75/11–13, 75/38; 266/161–163, 212, 214, 240, 248, 901, 900; 432/106, 115, 164

[56] References Cited

UNITED STATES PATENTS 3,912,501 10/1975 DeCostejon ..... 75/38

FOREIGN PATENTS OR APPLICATIONS 2,018,696 1971 Germany ..... 266/901
299,719 1971 U.S.S.R. ..... 432/106

*Primary Examiner*—Roy Lake
*Assistant Examiner*—Paul A. Bell
*Attorney, Agent, or Firm*—Cushman, Darby & Cushman

[57] ABSTRACT

A process and apparatus for the production of iron from iron ores, in which the ore is being heated and reduced in a rotary kiln by a treatment with solid carbon and with flame gas flowing in a countercurrent, the reduced iron is being collected and overheated in a first hearth furnace and is being fed in batches into a second hearth furnace, and is being converted there to pig iron, cast iron or steel, characterized in that the hot exhaust gases formed in the second hearth furnace are passed into the first hearth furnace and then through the rotary kiln together with the hot exhaust gases produced in the first hearth furnace.

5 Claims, 6 Drawing Figures

PROCESS FOR THE PRODUCTION OF IRON FROM IRON ORES AND APPARATUS FOR CARRYING OUT SAID PROCESS

This is a division, of application Ser. No. 551,012 filed Feb. 19, 1975.

This invention relates to a process for the production of iron from iron ores, in which the ore is heated and reduced in a rotary kiln by a treatment with solid carbon and with flame gas flowing in a countercurrent, and the reduced iron is collected and overheated in a first hearth furnace and is converted in a second hearth furnace to pig iron, cast iron or steel having a desired composition. This invention further relates to an apparatus for carrying out said process.

In such known processes and apparatuses, steel may be produced, e.g. from iron ore, in a plurality of successive steps or continuously without need for a blast furnace so that the ore and fuel need not be of particularly high grade. This purpose is served best by the use of a rotary kiln as a first unit. It is known to produce in the rotary kiln a mixture of sponge iron and gangue from, e.g., fine-grained ore, coal, and additives, and to cool said mixture, to separate the gangue and to subject the sponge iron to further processing in the blast furnace or the steel-melting furnace. In the known arrangement of this kind, the rotary kiln may be used for a uniflow or a counterflow operation, i.e., the flame gases and reducing gases may flow in the same direction as the material being treated or opposite thereto. Counterflow operations usually require less fuel because there is a uniform, high temperature difference between the heating gas and the material to be heated. The rotary kiln may be provided with sheathed pipes or sheathed burners for an improved temperature control. It is also known to provide at the discharge end of the rotary kiln a hearth furnace and to melt the discharged material so that metal and gangue are separated. Melting may be effected by burners for burning gaseous, liquid or solid fuels, or by means of electric energy. It is also known to burn the excess carbon present in the material discharged from the rotary kiln in order to produce the heat required for melting. In accordance with the state of the art, the gaseous reaction products developed in the hearth furnace are directly discharged into the open air in these cases. It has already been proposed to continuously discharge the iron collected in the hearth furnace with removal of the slag or to continuously supply said iron in a continuous stream through an elongated hearth furnance and to refine therein said iron, by blowing oxygen onto said iron, to steel, and to continuously add there the desired alloying elements, in which case the waste gases produced during the refining process are being fed through the rotary kiln. In this case, the waste gases could, theoretically, be used best. This process, however, has never been used in practice because each processing stage is being disturbed by the continuously supplied melt and thus the production of products of higher quality and of the desired composition is not possible.

It has further been proposed to supply the iron collected in the hearth furnace in batches to an electric arc furnace of special construction and to convert there said iron to steel. That known arrangement of furnace units in succession, comprising a rotary kiln and two successive hearth furnaces succeeding the rotary kiln, involves no energy losses due to an intermediate cooling of the material being treated but nevertheless has not been used in practice. This is due to the fact that the energy consumption is still too high, particularly in the extraction of iron from low-grade iron ore, in spite of the fact that said processes are said to be particularly suitable for treating such ores.

It is an object of the invention to eliminate this disadvantage.

In a process in which the furnace combination mentioned above is used, this object is accomplished in that the hot exhaust gases formed in the second hearth furnace are passed into the first hearth furnace and then through the rotary kiln, together with the hot exhaust gases produced in the first hearth furnace. If the reduced and carburized iron is converted to steel by being refined and, if desired, finished, in the second hearth furnace, the highest temperatures will be obtained in the latter so that the resulting reducing exhaust gases from said furnace will have the highest temperatures and when passed through the first hearth furnace can assist the heating of the largely reduced iron and gangue coming from the rotary kiln. The gases produced by this reaction are also reducing, e.g., because there is a certain surplus of carbon in the material discharged from the rotary kiln, and together with the exhaust gases from the second hearth furnace promote the process in the rotary kiln so that only a small supply of energy is required. The temperature gradient between the second hearth furnace and, via the interpositioned first hearth furnace, the rotary kiln can thus be used best for attaining maximum economy of the process.

In the practice of the invention, iron having a carbon content above 1% may be produced in the first hearth furnace owing to the presence of an excess of carbon. This will be desirable particularly in the processing of low-iron ore because in that case the iron content of the slag obtained in a large quantity will be low and a high yield will be ensured. If carburization is effected in the first hearth furnace, the slag may be withdrawn from the first hearth furnace and need not be transferred into the second hearth furnace for a reduction. Alternatively, pig iron may be produced in the first and/or second hearth furnace in the presence of an excess of carbon and is then refined to steel in another vessel.

The apparatus for carrying out the process according to the invention comprises a rotary kiln and two hearth furnaces, the rotary kiln and the hearth furnaces being arranged one behind the other, and is substantially characterized in that the furnace chambers of the rotary kiln and hearth furnaces are tightly connected to each other and an outlet for exhaust gases is provided only at the charging end of the rotary kiln. As a result, all exhaust gases being formed flow in all treating stages always countercurrent to the material being treated.

According to the invention, the first hearth furnace and suitably also the second hearth furnace may be arranged to be tiltable about the axis of rotation of the rotary kiln. In this case, the slag which collects in the first heart furnace can easily be removed by tilting the furnace after said slag has been reduced. Besides, there is no need for a duct for the transfer from the rotary kiln to the first hearth furnace. The discharge end of the rotary kiln may extend directly into the heating chamber of the first hearth furnace. For this purpose, the discharge end of the shell of the rotary kiln is preferably water-cooled. If, in accordance with the invention, the second hearth furnace is also arranged to be tiltable about the axis of rotation of the rotary kiln, a short transfer duct between the furnace chambers of the two hearth furnaces will be sufficient.

To eliminate the need for any transfer duct and to enable a direct transfer of the material being treated from the hearth of the first hearth furnace into the hearth of the second, it is a furnace of the invention that the two hearth furnaces are firmly interconnected and comprise a common arched roof and are separated by a weir, which has portions of different height which adjoin respective side walls of the furnace and is preferably lower on that side of the furnace which is remote from the pouring side. In this case, the two hearth furnaces can be emptied by being tilted or the slag may be removed by tilting or the contents of the first hearth furnace can be transferred from the first hearth over the lower portion of the weir into the second hearth. If the weir is lower on that side of the furnace which is remote from the pouring side, the furnaces may be emp'ied or the slag may be removed in a simple manner by a tilting in one direction and the contents of the first hearth may then be transferred into the second hearth by a tilting in the other direction without need for closing the pouring outlets. According to the invention the hearth of the second hearth furnace may lie at a lower level than the hearth of the second hearth furnace. This arrangement affords the advantage that the contents of the first hearth furnace can be entirely or almost entirely transferred into the second hearth furnace by a tilting toward the lower side of the weir.

An embodiment of the invention will be described more fully and by way of example with reference to the diagrammatic drawing.

FIG. 2 shows the hearth furnaces in their normal position.

FIG. 3 shows them in a position to which they have been tilted in a counterclockwise sense and in which slag is dumped out of the first hearth furnace.

FIG. 4 shows them in a position to which they have been tilted in a clockwise sense and in which molten material flows from the first hearth furnace into the second, FIG. 5 shows them in a position for melting and FIG. 6 shows them in a position to which they have been tilted to the left for pouring the final steel from the second hearth furnace.

Figure 1:
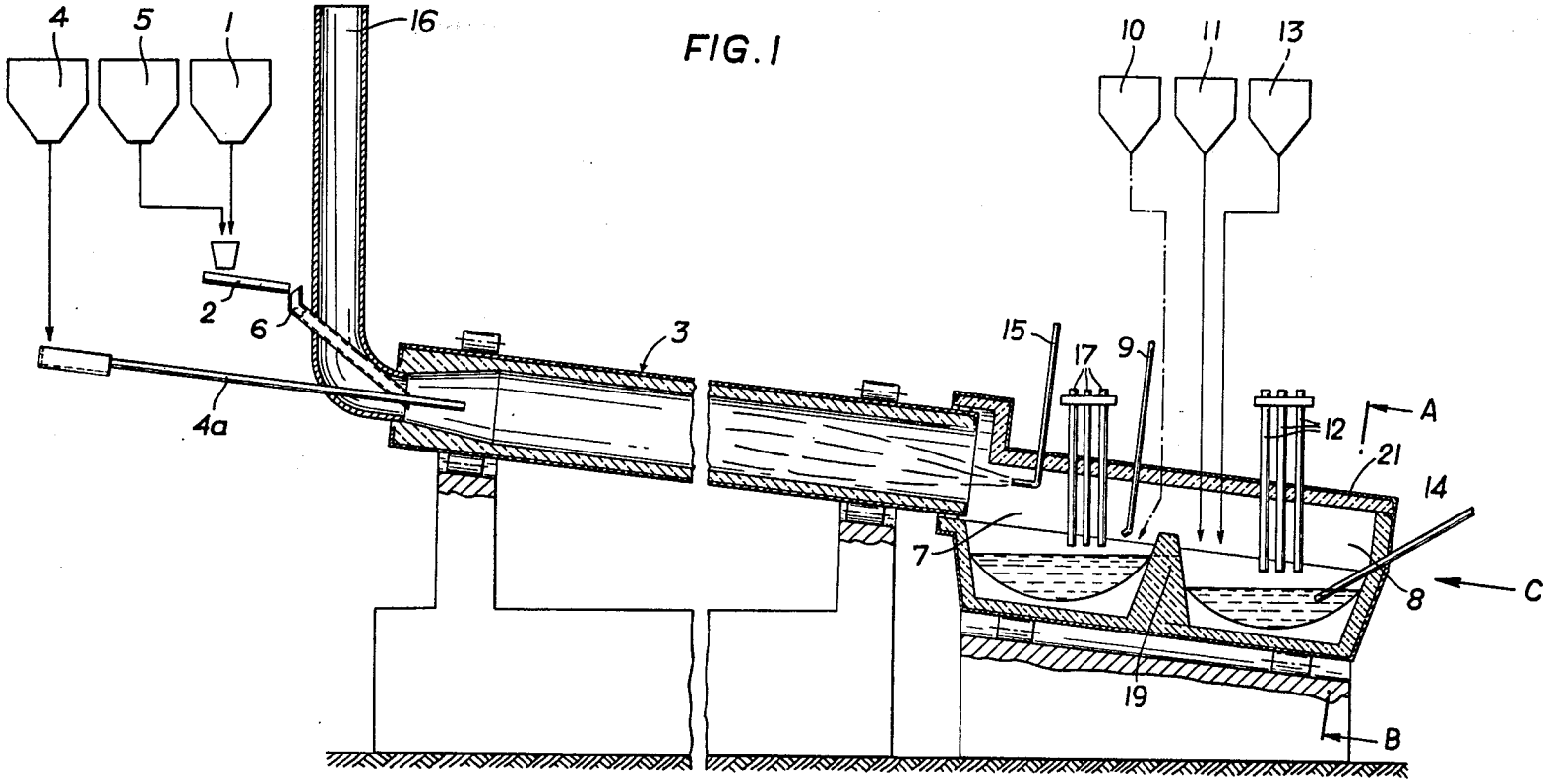
FIG. 1 is a longitudinal sectional view showing the entire furnace combination.

Ore from a bin 1 and, e.g., lime as a slag-forming constituent from a bin 5, are charged over a vibrator 2 and a chute 6 into a rotary kiln 3 of conventional type. Coal, coal grit or coke grit from another bin 4 is injected by means of a blowing lance 4a.

In the rotary kiln 3, moisture and water of hydration are expelled and the ore is roasted, if this is required. As the ore continues to travel through the rotary kiln 3, it is reduced to a great extent, e.g., to a degree of metallization of 80 to 90%, at temperatures of about 1000° C. The rotary kiln 3 is fired with economical energy carriers, such as coal dust, powdered coke, natural gas or fuel oil by means of a burner 15 and, if desired, of sheathed burners, not shown. The CO-containing hot exhaust gases from the hearth furnaces 7 and 8 are also passed through the rotary kiln and burnt therein. The exhaust gases ultimately leave the furnace combination through the chimney 16 at temperatures of 400 to 500° C.

The solid, pasty or semiliquid mixture of iron, slag and unreduced ore flows continuously from the rotary kiln 3 onto the hearth of the first hearth furnace 7, in which it is collected and heated to the melting temperature. This temperature rise is effected by a partial combusition of the CO-containing exhaust gases from the hearth furnace 8, by a partial combustion of the excess coal present in the material discharged from the rotary kiln, and by means of roof burners 9 and electrodes 17. The final reduction of the ore and a carburization of the iron are thus effected. The carburization is also effected by the excess of carbon present in the material discharged from the rotary kiln and, if desired, additional carbon which is injected, noting that the lower the iron content of the ore, the higher must be the degree of carburization, so that the quantity of iron lost in the slag can be minimized. The Co-containing hot gases produced by these reactions are being exhausted via the rotary kiln 3. Slag-forming materials from a bin 10 may be added as required.

Figure 2:
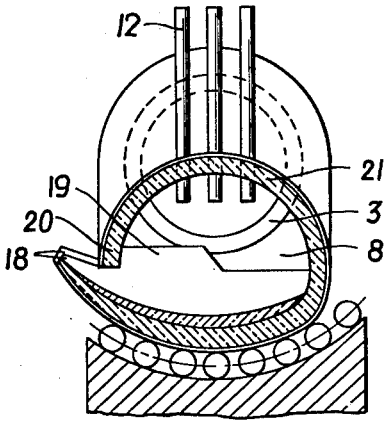
FIGS. 2 through 6 are sectional views showing the second hearth furnace and taken on a plane which is at right angles to the pivotal axis thereof, the view being taken in the direction of arrow C and the hearth furnaces being shown in their different positions.
Figure 3:
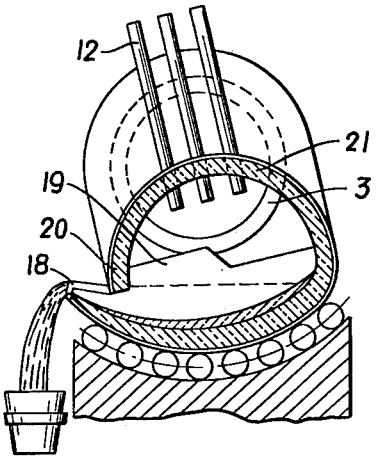
Figure 4:
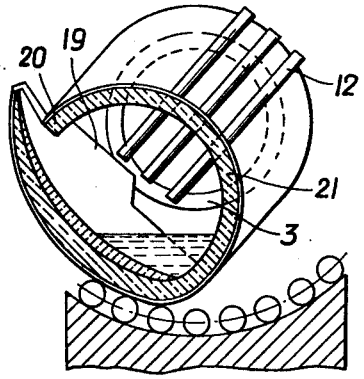
Figure 5:
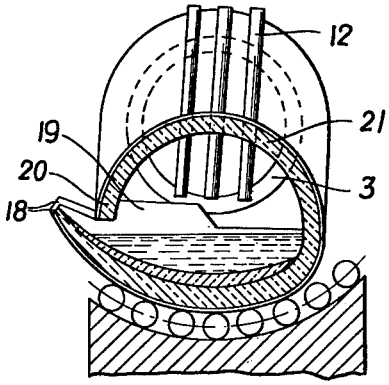
Figure 6:
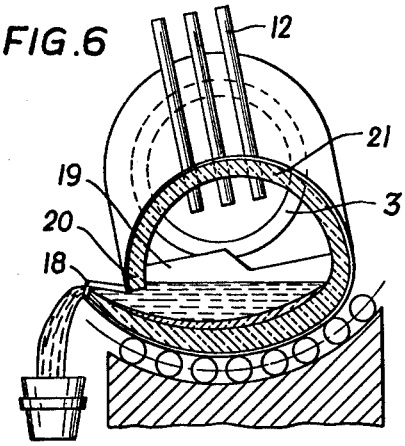

When the desired quantity of molten iron and slag has collected in the hearth furnace 7, the latter is tilted toward the side on which the spouts 18 are disposed so that the slag runs off (FIGS. 2 and 3). The furnace is subsequently tilted to the opposite side (FIG. 4). In view of the hearth furnaces 7 and 8 being structually combined to form a double furnace, which has a common arched roof 21 for both furnaces and instead of a partition wall between the furnaces a stepped weir 19, which is high near the side wall 20 providd with the tapping openings or spouts 18 and low near the opposite side wall 21, and in view of the hearth of the hearth furnace 8 being lower than the hearth of the hearth furnace 7, the major part of the contents of the hearth furnace 7 is being discharged into the hearth furnace 8. The higher evaluation of the bottom of the first hearth furnace 7 is due to the fact that the two hearth furnaces 7 and 8 are tilted about the inclined pivotal axis 22 of the rotary kiln 3. Because the pivotal axis of the double hearth furnace 7, 8 coincides with the axis of rotation of the rotary kiln 3, the double hearth furnace can be tilted through a very large angle without adversely affecting the seal between the rotary kiln 3 and the furnace 7 so that the hearth furnace 7 as it is tilted never ceases to collect the material discharged from the rotary kiln. As soon as a major part of the contents of the furnace 7 has beeb transferred into the furnace 8, the furnaces 7, 8 are restored to their normal position (FIG. 5). Depending on the degree to which the carburization has been effected in the furnace 7, the furnace 8 contains either high-carbon steel or pig iron. Slag-forming materials are charged from the bins 11 and 13 and melting in effected by means of the electrodes 12. The electrodes 12 are then raised and oxygen is injected through the lance 14 until the charge has been refined to form the desired steel. Depending on the desired quality of the steel, the tap hole may be opened and the furnace may be slightly tilted (FIG. 6) to pour the steel into the ladle, or only the slag may be dumped and the molten steel may be finished and alloyed under a new slag. The CO-containing gases formed during the refining and finishing operations are passed through the hearth furnace 7 into the rotary kiln 3. As a result, there is a counterflow operation not only in the rotary kiln but in all process steps from the ore to the final steel so that the chemical and sensible heats of all exhaust gases are optimally utilized and particularly small quantity of heat is required for the overall process.

A person skilled in the art will easily recognize that the invention permits the use of larger quantities of scrap. The individual process steps may be modified. For instance, the hearth furnace 7 may be operated as a mere collecting and overheating furnace and carburization may be effected in the second hearth furnace 8. Each hearth furnace may have a separate tap hole and tap spout and the tap holes may be closed, and may be opened as required so that all or part of the metal and/or slag may be removed from either hearth furnace without a disturbance of the process taking place in the other hearth furnace at the same time. The invention also eliminates the need for a production of pig iron as an intermediate product unless this is essential in view of the quality of the ore. Ores having a sufficiently high content in Fe may be processed directly to steel.

This plurality of processing possibilities are, by the invention, provided by further processing in batches the product continuously discharged from the rotary kiln, so that it becomes possible to switch over at any time from the production of one product to the production of another product, e.g., a steel of another composition, and thereby to maintain the economic advantages of a continuous process.

We claim:

1. Apparatus for the production of iron from iron ores comprising: a rotary kiln for reducing iron ore with carbon, said kiln having a discharge end for discharging a mixture of iron, slag and unreduced ore; a first hearth furnace for receiving the discharge from the discharge end of the kiln, said furnace having opposed side walls and end walls, one of which comprises a weir, which walls extend between the side walls, said weir having a lower height adjacent one side wall; a second hearth furnace separated from the first furnace by said weir and in communication with the first furnace above said weir; and means mounting said furnaces for tilting movement about a common axis extending through the plane of the wall comprising the weir so that fluid material can be transferred from the first furnace to the second furnace by tilting said furnaces in a direction to lower the position of said weir.

2. Apparatus as in claim 1 wherein that side wall of the second furnace which is adjacent the higher portion of the weir includes a pour aperture.

3. Apparatus as in claim 1 wherein said tilting axis of the furnace is in alignment with the rotary axis of the kiln and wherein said kiln and furnaces are in sealing engagement with each other so that exhaust gases from the furnaces pass into the discharge end of said kiln.

4. Apparatus as in claim 1 wherein said first and second hearth furnaces include a top wall in the form of an arched roof common to both furnaces.

5. Apparatus as in claim 1 wherein the hearth of the second furnace is disposed at a lower level than the hearth of the first furnace.

* * * * *